US009663973B2

(12) United States Patent
Foster

(10) Patent No.: US 9,663,973 B2
(45) Date of Patent: May 30, 2017

(54) WATER METER PIT COVER LATCH

(75) Inventor: Derick Foster, Huntington Beach, CA (US)

(73) Assignee: Rehrig Pacific Company, Los Angeles, CA (US)

( * ) Notice: Subject to any disclaimer, the term of this patent is extended or adjusted under 35 U.S.C. 154(b) by 465 days.

(21) Appl. No.: 13/080,707

(22) Filed: Apr. 6, 2011

(65) Prior Publication Data

US 2011/0303675 A1 Dec. 15, 2011

Related U.S. Application Data

(60) Provisional application No. 61/353,391, filed on Jun. 10, 2010.

(51) Int. Cl.

| | |
|---|---|
| ***E05C 3/12*** | (2006.01) |
| ***E05B 65/00*** | (2006.01) |
| ***E05B 35/00*** | (2006.01) |
| ***E05C 3/04*** | (2006.01) |

(52) U.S. Cl.

CPC ..... *E05B 65/006* (2013.01); *E05B 35/008* (2013.01); *E05C 3/042* (2013.01); *Y10T 292/1077* (2015.04)

(58) Field of Classification Search

CPC ..... E05B 65/006; E05B 35/008; E05C 3/042; Y10T 292/1077

USPC ..... 220/324, 484; 292/101, 102, 105, 108, 292/240, 241, 200, 202, 203, 197

See application file for complete search history.

(56) References Cited

U.S. PATENT DOCUMENTS

| | | | | |
|---|---|---|---|---|
| 1,684,983 | A * | 9/1928 | Clark | 292/304 |
| 1,923,481 | A * | 8/1933 | Ford | 220/484 |
| 3,479,076 | A * | 11/1969 | Schallehn | 292/67 |
| 4,048,766 | A * | 9/1977 | Dantzer et al. | 52/19 |
| 4,784,417 | A * | 11/1988 | Fleming et al. | 292/347 |
| 5,230,542 | A * | 7/1993 | Wiese | 292/340 |
| 5,688,003 | A * | 11/1997 | Beale | 292/202 |
| 5,747,687 | A * | 5/1998 | Edwards et al. | 73/277 |
| 5,950,368 | A * | 9/1999 | Bradford | 52/20 |
| 7,619,878 | B1 * | 11/2009 | Cook | 361/672 |
| 2002/0089428 | A1 * | 7/2002 | Walden et al. | 340/870.02 |
| 2007/0210087 | A1 * | 9/2007 | McCormick | H02B 1/28 220/484 |
| 2009/0084793 | A1 * | 4/2009 | Anderson | B28B 21/24 220/484 |
| 2009/0242565 | A1 * | 10/2009 | McLachlan | B65F 1/1457 220/484 |
| 2009/0277909 | A1 * | 11/2009 | Buttz | E03B 7/072 220/484 |
| 2009/0277910 | A1 * | 11/2009 | Buttz | E03B 7/072 220/484 |
| 2009/0289068 | A1 * | 11/2009 | Baker | B65D 88/76 220/484 |

* cited by examiner

*Primary Examiner* — King M Chu

(74) *Attorney, Agent, or Firm* — Carlson, Gaskey & Olds, PC

(57) ABSTRACT

A water meter pit assembly includes a water meter pit frame defining an opening and a cover supported within the opening. A latch is moveable between a locked position where the cover is held fixed relative to the water meter pit frame to close the opening and an unlocked position where the cover is moveable relative to the water meter pit frame to allow access to the opening. The latch comprises a rotatable cam that engages the water meter pit frame when in the locked position.

28 Claims, 6 Drawing Sheets

WATER METER PIT COVER LATCH

RELATED APPLICATION

This application claims priority to U.S. Provisional Application 61/353,391 filed on Jun. 10, 2010.

TECHNICAL FIELD

The present invention relates to water meter pit cover latch that can be used with flush and cap style lids.

BACKGROUND OF THE INVENTION

Water meter pits house equipment for monitoring an amount of water that is being supplied to a commercial property or private residence, for example. These pits are enclosed by a cover that includes a latch to securely lock the cover in place. The cover sits in a frame, which can be made from cast iron, aluminum, or plastic for example. Further, the cover can be configured to be flush with the frame, or can have a cap configuration where a lip portion extends peripherally outwardly from the frame. The latch must securely hold the cover in place. One traditional latch comprises a worm gear configuration. This type of latch cannot easily be used with the different frame materials and different cover configurations.

SUMMARY OF THE INVENTION

A water meter pit assembly includes a water meter pit frame defining an opening and a cover supported within the opening. A latch is moveable between a locked position where the cover is held fixed relative to the water meter pit frame to close the opening and an unlocked position where the cover is moveable relative to the water meter pit frame to allow access to the opening. The latch comprises a rotatable cam that engages the water meter pit frame when in the locked position.

In one example, the latch comprises a latch body with a pivot portion formed on the cam. The pivot portion includes a pivot opening to receive a pivot actuator.

In one example, the pivot actuator comprises a fastener having an enlarged head portion and a body portion that is received within the pivot opening. The enlarged head portion is accessible from an upper surface of the cover and can be selectively rotated to move the cam into engagement with the water meter pit frame.

In one example, the pivot opening is eccentrically positioned near an outer peripheral edge of the cam.

The latch can be used with a flush mounted cover or a cap mounted cover. Further, the latch can be used with frames that are made from cast iron, aluminum, or plastic materials, for example.

These and other features of the present invention can be best understood from the following specification and drawings, the following of which is a brief description.

DETAILED DESCRIPTION OF THE PREFERRED EMBODIMENT

Figure 1:
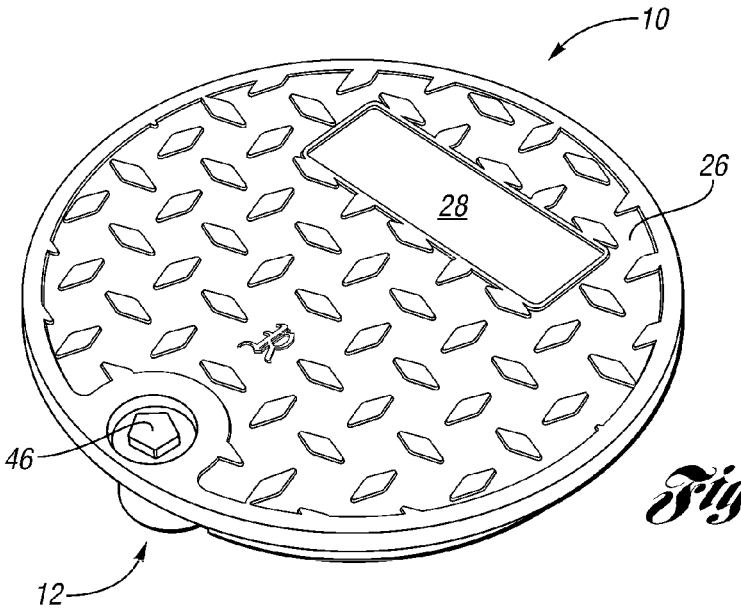
FIG. 1 is a perspective top view of a water meter pit cover with a latch.

FIG. 1 is a perspective top view of a water meter pit cover 10 with a latch assembly 12. As known, the cover 10 encloses a water meter pit, which is typically located within the ground. A water meter pit houses equipment for monitoring an amount of water that is being supplied to various discrete locations.

Figure 30:
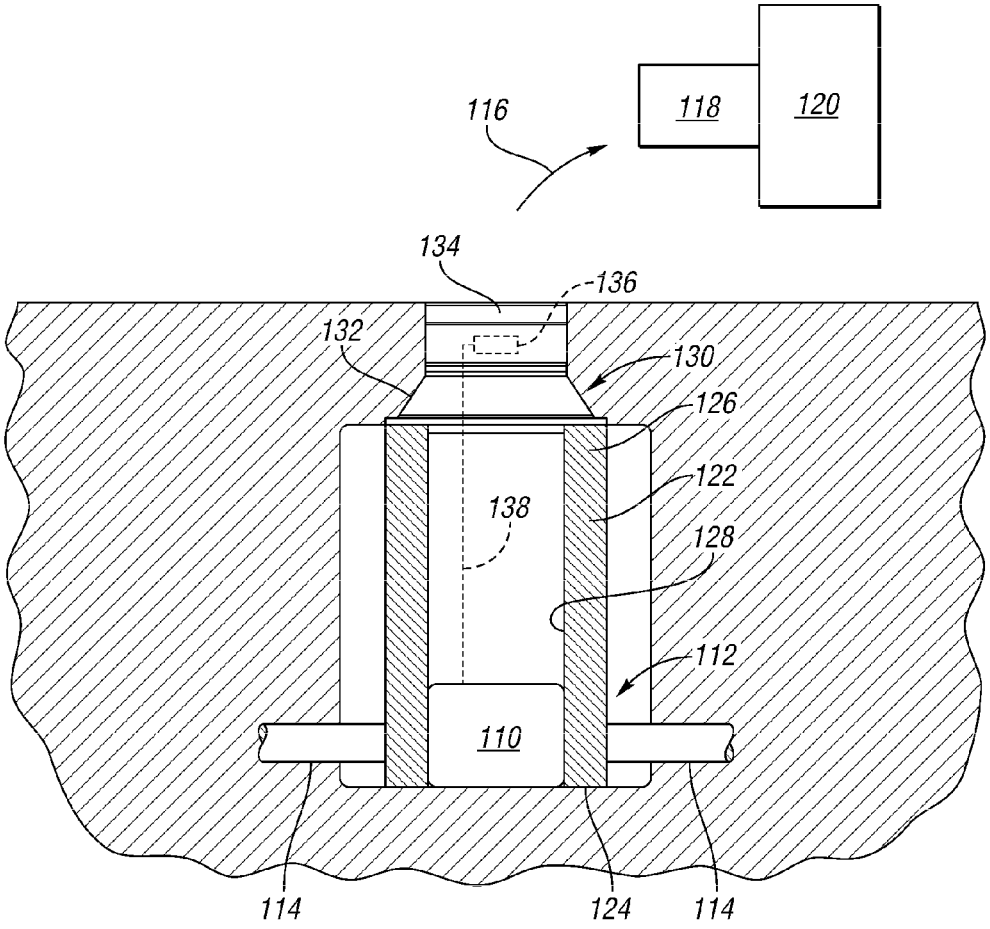
FIG. 30 is a schematic representation of a water meter pit for a cover and latch assemblies as shown in FIGS. 1-29.

An example configuration is shown in FIG. 30. A water meter 110 is located in a pit 112 that is dug in the ground. A water supply pipe 114, which is buried underground and extends across a bottom of the pit 112, is used to deliver water to specific locations, such as a businesses or residences for example. The water meter 110 monitors and measures the amount of water that is used for a specific location. This water meter data is transmitted via a wireless signal 116 to a receiving device 118 associated with a data collection device 120, such as a computer or hand-held meter reader for example, which is located above ground.

A water pit column 122 includes a first end 124 that is supported on a floor of the pit 112, and which extends upwardly to a second end 126. The water pit column 122 includes a central opening 128 that extends from the first end 124 to the second end 126. The water meter 110 is at least partly received within this central opening 128.

A water meter pit assembly 130 rests on top of the second end 126 of the water pit column 122. The water meter pit assembly 130 includes a frame 132 and cover 134 that is releasably secured to the frame 132 such that the cover 134 can be selectively attached and detached from the frame 132 to provide access to components located within the pit 112. The cover 134 is usually positioned to be flush with ground level but could also be slightly raised or lowered relative to ground level.

The frame 132 supports a transmitting component 136, such as a signal generator for example, that is connected to the water meter 110 with at least one wire connection 138. The wire connection 138 extends downwardly from the frame 132 through the central opening 128 in the water pit column 122, to a location where the wire is connected to the water meter 110. Data from the water meter 110 is then wirelessly transmitted by the transmitting component 136 to the receiving device 118. Any type of transmitting component and receiving device can be used to transmit and receive data from the water meter 110. FIGS. 1-29 show various examples of different types of covers 134 that use a common latch assembly.

As shown in FIG. 1, the cover 10 includes a latch assembly 12 such that the cover 10 can be securely latched in place to cover an opening in the frame 132 (FIG. 30). The latch assembly 12 is moveable between a locked position and an unlocked position where the cover 10 can be moved to provide access to the opening in the frame such that equipment in the water meter pit is accessible for data download or maintenance.

Figure 2:
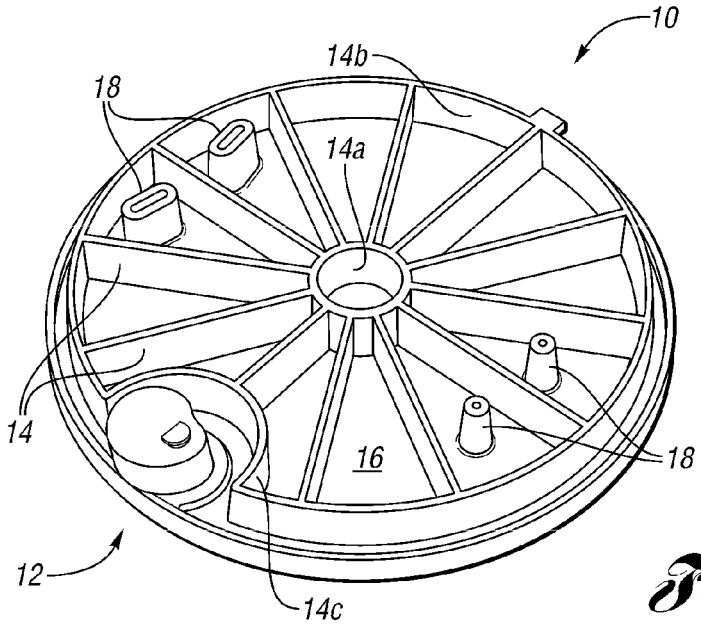
FIG. 2 is a bottom perspective view of the cover of FIG. 1.

FIG. 2 is a bottom perspective view of the cover 10 of FIG. 1. The cover 10 includes a plurality of ribs 14 formed within a bottom surface 16. The ribs 14 provide a more robust cover without significantly increasing the weight. In the example shown, a circular wall portion 14*a* extends outwardly from a center location on the bottom surface 16. The ribs 14 extend radially outwardly from the circular wall portion 14*a* to an outer periphery circular wall portion 14*b*. The outer periphery circular wall portion 14*b* includes an inwardly curved portion 14*c* that surrounds a portion of the latch assembly 12 that faces toward a center of the cover 10. The bottom surface 16 also includes a plurality of mounting bosses 18 that mount to brackets within the meter pit.

Figure 3:
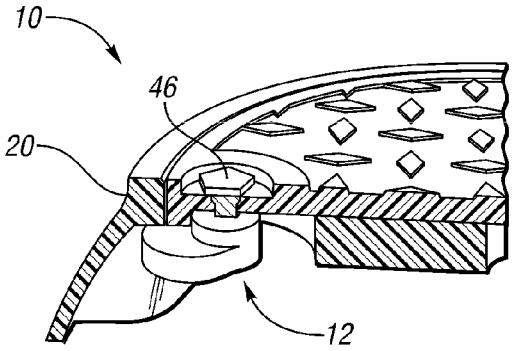
FIG. 3 is a cut-away view of the latch of FIG. 1.

FIG. 3 is a cut-away view of the latch assembly 12 of FIG. 1. This view shows the latch assembly 12 in a locked position. The cover 10 in this example sits within a frame 20 in a flush mount configuration. A portion of the latch assembly 12 has been rotated into abutting engagement with an inner peripheral surface of the frame 20 to achieve the locked position.

Figure 4:
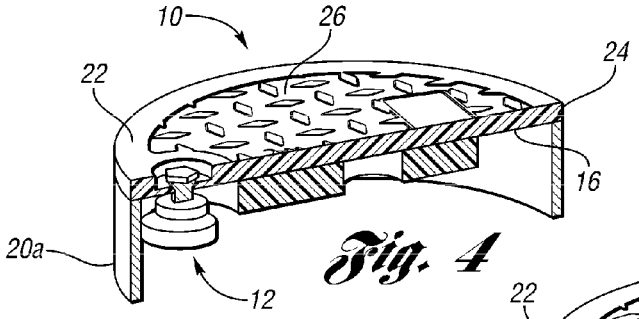
FIG. 4 is a cut-away view of the cover on a cast iron frame.
Figure 5:
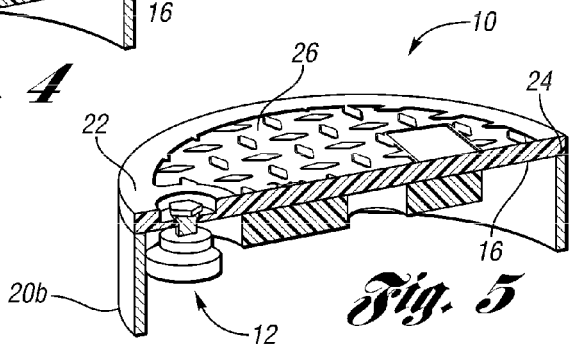
FIG. 5 is a cut-away view of the cover on an aluminum frame.

FIG. 4 is a cut-away view of the cover 10 on a cast iron frame 20*a*. FIG. 5 is a cut-away view of the cover 10 on an aluminum frame 20*b*. In each of these configurations, the cover 10 is a cap style mount configuration where the cover 10 includes a peripheral outer edge portion 22 that sits on top of an upper edge surface 24 of the respective frame 20*a*, 20*b*.

Figure 6:
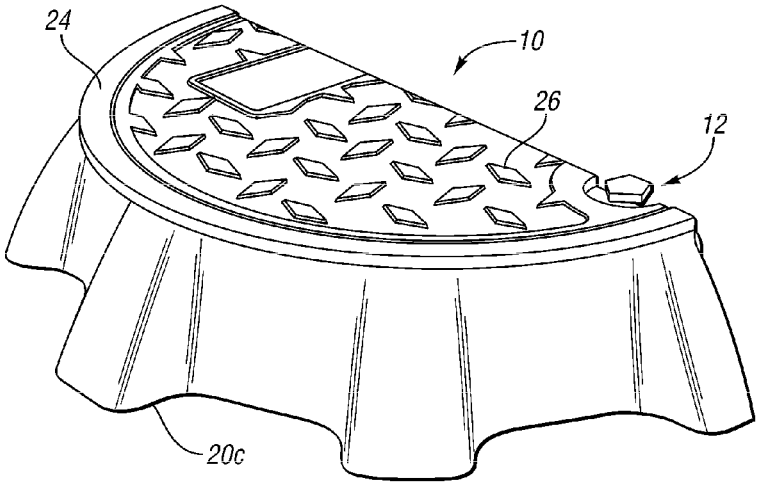
FIG. 6 is a cut-away view from the rear of the cover on a profiled plastic frame.
Figure 7:
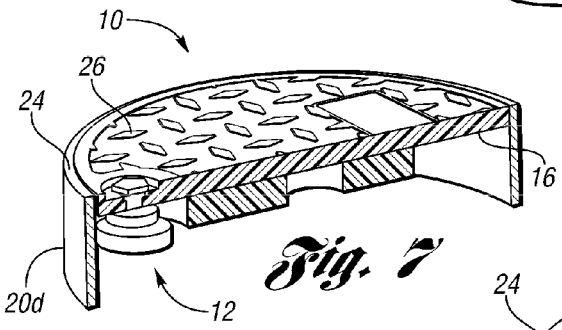
FIG. 7 is a cut-away view of the cover in a flush configuration on a cast iron frame.
Figure 8:
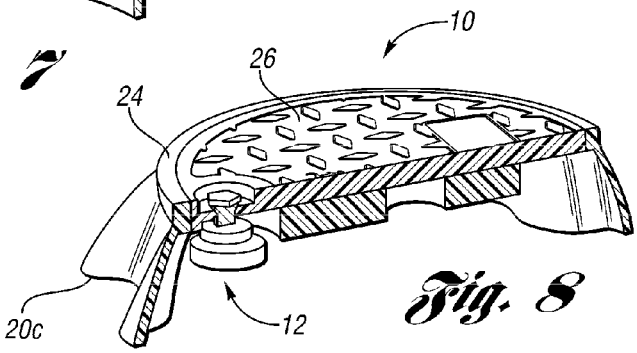
FIG. 8 is a cut-away view of the cover in a flush configuration on a plastic frame.
Figure 9:
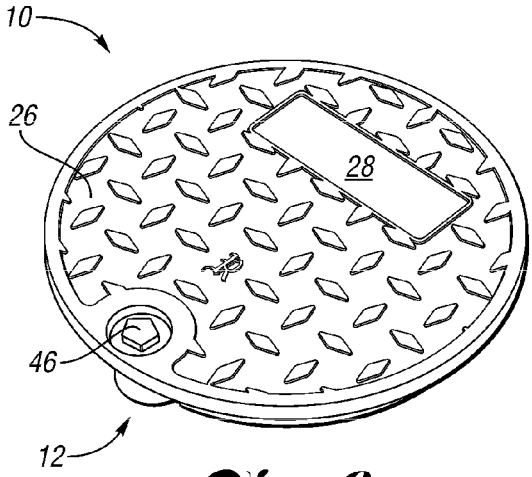
FIG. 9 is a perspective view of one example of a flush style cover.

FIG. 6 is a cut-away view from the rear of the cover 10 on a profiled plastic frame 20*c*. FIG. 7 is a cut-away view of the cover 10 on a cast iron frame 20*d*. FIG. 8 is a cut-away view from the front of the cover 10 of FIG. 6. In each of these configurations, the cover 10 is in a flush mount configuration where an upper surface 26 of the cover 10 is flush with the upper edge surface 24 of the respective frame 20*c*, 20*d*.

Figure 10:
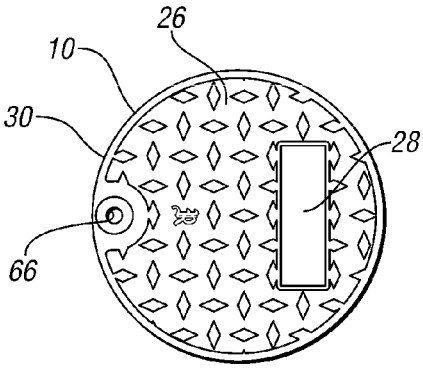
FIG. 10 is a top view of the cover of FIG. 9.
Figure 11:
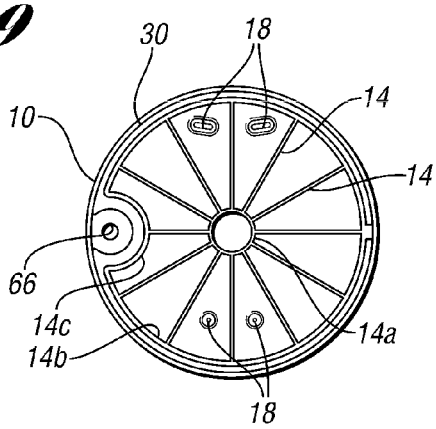
FIG. 11 is a bottom view of the cover of FIG. 9.
Figure 12:
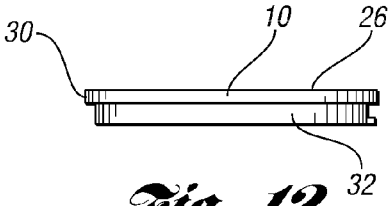
FIG. 12 is a side view of the cover of FIG. 9
Figure 13:
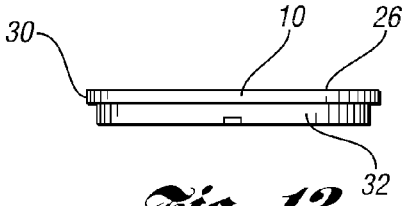
FIG. 13 is an opposite side view of the cover of FIG. 9.
Figure 14:
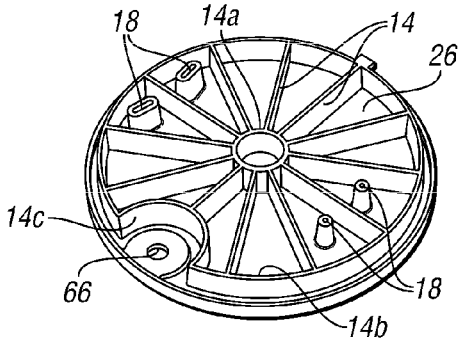
FIG. 14 is a bottom perspective view of the cover of FIG. 9.
Figure 15:
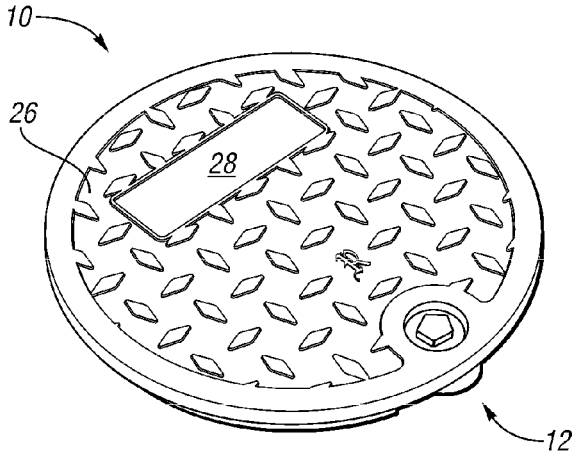
FIG. 15 is a perspective view of one example of a cap style cover.

FIGS. 9-14 disclose the flush style cover 10 in greater detail. The flush style cover 10 can be used with a frame made of various types of materials including cast iron, aluminum, and plastic, for example, as discussed above. The cover 10 is generally circular in shape; however, other shapes could also be used. The upper surface 26 can include a textured surface as shown in FIG. 10, with a non-textured area 28 that can be used for identifying information, for example. The cover 10 includes an outer periphery 30, with the latch assembly 12 being located immediately adjacent the outer periphery 30. As discussed above, ribs 14 are formed in the bottom surface 16 to increase the structural strength of the cover 14. A downwardly extending portion 32, located radially inward of the outer periphery 30 and providing the outer periphery circular wall portion 14*b*, is received within the frame 20. Once installed the upper surface 26 will sit flush with the upper edge surface 24 of the frame 20, 20*c*, 20*d*.

Figure 16:
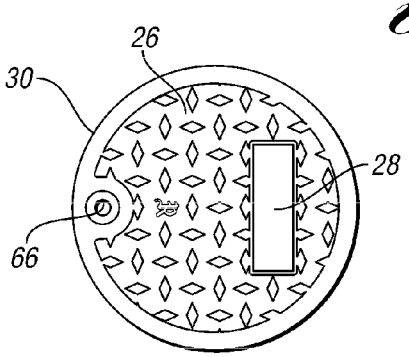
FIG. 16 is a top view of the cover of FIG. 15.
Figure 17:
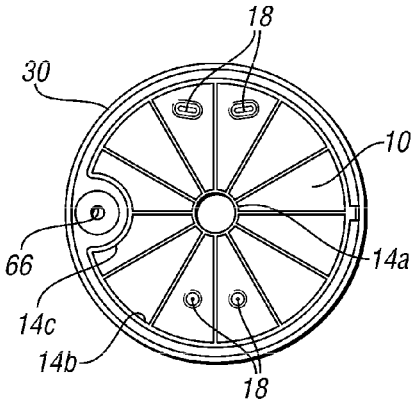
FIG. 17 is a bottom view of the cover of FIG. 15.
Figure 18:
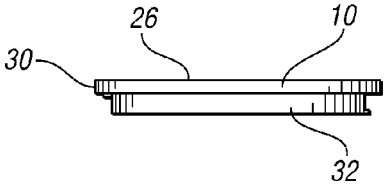
FIG. 18 is a side view of the cover of FIG. 15
Figure 19:
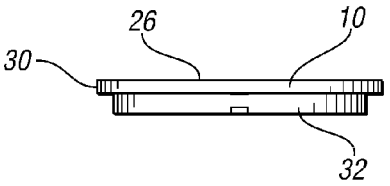
FIG. 19 is an opposite side view of the cover of FIG. 15.
Figure 20:
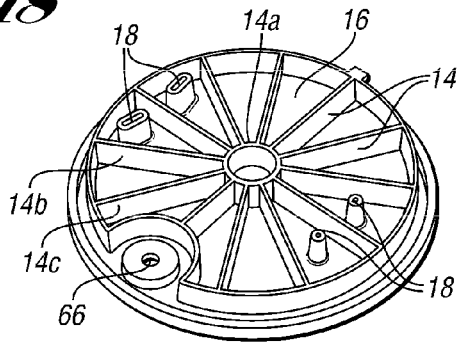
FIG. 20 is a bottom perspective view of the cover of FIG. 15.
Figure 21:
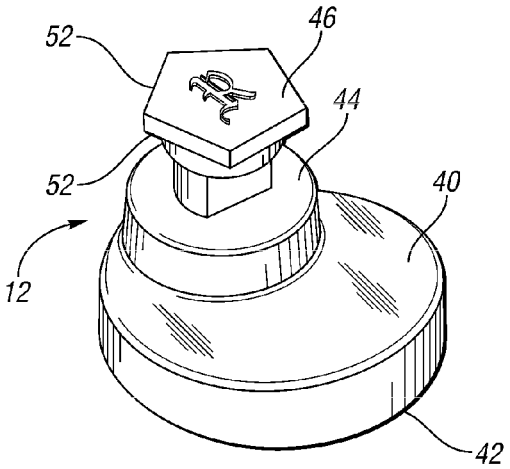
FIG. 21 is a perspective view of a latch assembly to be used with any of the covers set forth above.
Figure 22:
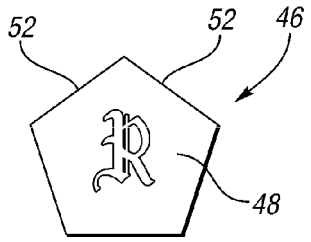
FIG. 22 is a top view of a bolt of the latch assembly of FIG. 21.
Figure 23:
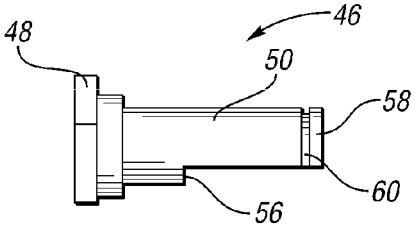
FIG. 23 is a side view of the bolt of FIG. 22.
Figure 24:
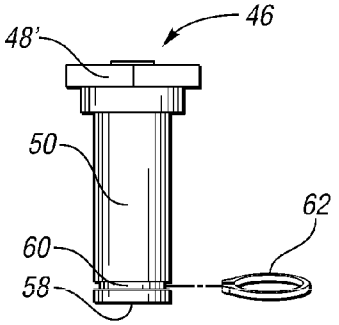
FIG. 24 is an opposite side view of the bolt of FIG. 22
Figure 25:
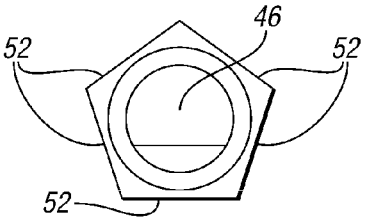
FIG. 25 is a cross-sectional view of the bolt of FIG. 22.
Figure 26:
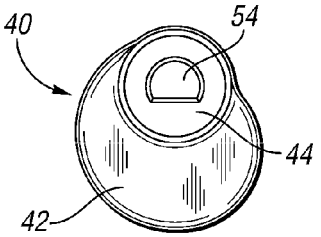
FIG. 26 is a top view of the latch assembly of FIG. 21.
Figure 27:
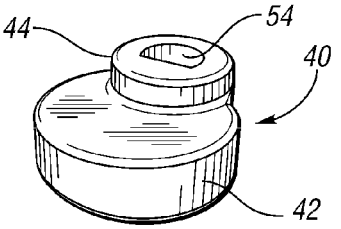
FIG. 27 is a perspective view of the latch assembly of FIG. 21.

FIGS. 15-20 disclose the cap style cover 10 in greater detail. The cover 10 is also generally circular in shape; however, other shapes could also be used. The upper surface 26 can include a textured surface as shown in FIG. 16, with a non-textured area 28 that can be used for identifying information, for example. The cover 10 includes an outer periphery 30, with the latch assembly 12 being located immediately adjacent the outer periphery 30. Ribs 14 are formed in the bottom surface 16 to increase the structural strength of the cover 10. A downwardly extending portion 32, located radially inward of the outer periphery 30 and providing the outer periphery circular wall portion 14*b*, is received within the frame 20. In this configuration, the outer periphery 30 is greater in diameter than an inner diameter of the frame 20*a*, 20*b*. Once installed, the outer periphery 30 will sit on top of the upper edge surface 24 of the frame 20*a*, 20*b* in a cap configuration.

FIGS. 21-29 show the latch assembly 12 in greater detail. The latch assembly 12 includes a latch body 40 with sloped cam portion 42 and a pivot portion 44. The cam portion 42 and pivot portion 44 are integrally formed together from a glass-filled nylon material. A fastener, such as a bolt 46 for example, is installed within the pivot portion 44 and is operable to pivot the latch body 40 between the locked and unlocked positions.

The bolt 46 includes an enlarged head portion 48 and a body portion 50 that extends downwardly from the head portion 48. The head portion 48 includes a plurality of flats 52 such that the bolt 46 can be easily gripped by an appropriate tool. The body portion 50 has a D-shaped cross-section that is received within a corresponding D-shaped hole or opening 54 in the pivot portion 44. The body portion 50 has a first portion of a larger cross-section and a second portion with a smaller cross-section such that an abutment surface 56 is provided. This abutment surface 56 provides a stop for the bolt 46 when it is inserted into the pivot portion 44. A distal end 58 of the body portion 50 includes a groove 60 to receive a retainer ring 62 to further secure the bolt 46 in place. The bolt 46 extends through an opening 66 (FIGS. 14 and 20) formed within the cover 10 so that the head portion 48 is accessible.

The latch body sits underneath the cover 10 and is shown in greater detail in FIGS. 26-29. The sloped cam portion 42 is comprised of an ovoid shape with the pivot portion 44 being located at an offset position on the cam portion 42. In other words, the pivot portion 44 is eccentrically positioned near an outer edge of the cam portion 42. The pivot portion 44 comprises a raised boss that extends upwardly from the larger base cam portion 42.

Figure 28:
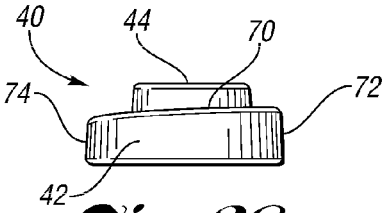
FIG. 28 is a side view of the latch assembly of FIG. 21.
Figure 29:
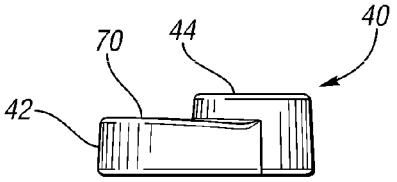
FIG. 29 is an opposite side view of the latch assembly of FIG. 21.

The cam portion 42 has a sloped surface 70 which is clearly shown in FIG. 28. The sloped surface 70 slopes from one edge 72, which has the thickest cross-section, to an opposite edge 74, which has the thinnest cross-section. The pivot portion 44 is positioned away from the thicker edge 72. When the bolt 46 is turned in a clockwise direction when viewed from above, the latch body is eccentrically rotated such that the thicker edge 72 is rotated into abutting engagement with the frame 20 to securely lock the cover 10 in place.

One advantage with the subject latch assembly 12 is that the latch assembly can be used with any frame configuration, e.g. flush or cap style. Further, the subject latch assembly can be used with any type of frame material, e.g. plastic, cast iron, aluminum, etc. The latch is assembled to the cover by placing the latch body underneath the cover and then inserting the bolt 46 through the opening 66 in the upper surface 26 of the cover 10. During insertion, the bolt 46 is pushed through the D-shaped opening 54 until the abutment surface 56 contacts the latch body at an upper surface of the pivot portion 44. The retainer ring 62 is then snapped into the groove 60 to prevent the bolt 46 from being withdrawn from the cover 10. A tool (not shown) can then be used to grip the flats 52 on the bolt 46 to move the latch between the locked and unlocked positions.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A water meter pit assembly comprising:

a water meter pit frame defining an opening, and wherein the water meter pit frame includes an inner peripheral wall surface extending from an upper end to a lower end configured to be supported by a water pit column;

a cover supported within the opening;

a latch moveable between a locked position where the cover is held fixed relative to the water meter pit frame to close the opening and an unlocked position where the cover is moveable relative to the water meter pit frame to allow access to the opening, and wherein the latch comprises a latch body received within a latch opening in the cover, the latch body including a pivot actuator configured to rotate the latch body and a rotatable cam that engages the inner peripheral wall surface of the water meter pit frame when in the locked position;

wherein the cam includes an outer peripheral surface that is in direct abutting engagement with the inner peripheral surface of the water meter pit frame when in the locked position;

wherein the pivot actuator is received within a pivot portion of the latch body that is positioned offset from a center of the cam; and wherein the pivot actuator includes an enlarged head portion and a body portion that extends downwardly from the head portion, and wherein the body portion has a first portion of a larger cross-section and a second portion with a smaller cross-section to define an abutment surface that provides a stop for the pivot actuator when inserted into the pivot portion.

2. The water meter pit assembly according to claim 1, wherein the water meter pit frame includes a base portion to be supported by a water pit column and a top portion that provides the opening.

3. The water meter pit assembly according to claim 1, wherein the water meter pit frame comprises a cast iron frame.

4. The water meter pit assembly according to claim 1, wherein the water meter pit frame comprises an aluminum frame.

5. The water meter pit assembly according to claim 1, wherein the water meter pit frame comprises a plastic frame.

6. The water meter pit assembly according to claim 1, wherein the cover includes an outer peripheral edge portion that rests on an upwardly facing end face of the water meter pit frame.

7. The water meter pit assembly according to claim 1, wherein the cover has an upper surface that is flush with an upwardly facing end face of the water meter pit frame.

8. The water meter pit assembly according to claim 1, wherein the cover includes an upper surface and a lower surface that includes a plurality of ribs.

9. The water meter pit assembly according to claim 8, wherein the upper surface comprises a textured surface with at least one non-textured surface for identifying information.

10. The water meter pit assembly according to claim 1, wherein the cover includes an upper surface and a lower surface, and wherein the cover includes a latch opening extending through a thickness of the cover from the upper surface to the lower surface to receive the latch.

11. The water meter pit assembly according to claim 10, wherein the cover defines an outer periphery and wherein the latch opening is positioned adjacent the outer periphery.

12. The water meter pit assembly according to claim 11, wherein the latch is selectively rotated to move a peripheral side surface of the cam into engagement with the inner peripheral wall surface of the water meter pit frame to achieve the locked position, the peripheral side surface of the cam contacting the inner peripheral wall surface at a location spaced from the upper end of the water meter pit frame.

13. The water meter pit assembly according to claim 1, wherein the latch body includes the cam and a pivot portion that defines a pivot opening that receives the pivot actuator.

14. The water meter pit assembly according to claim 13, wherein the cam and the pivot portion are integrally formed together as a single-piece component.

15. The water meter pit assembly according to claim 13, wherein the cam includes a sloped surface that slopes from one edge of the latch body having a thickest cross-section to an opposite edge of the latch body that has a thinnest cross-section.

16. The water meter pit assembly according to claim 15, wherein a peripheral side surface of the cam at the thickest cross-section is rotated by the pivot actuator into engagement with the inner peripheral wall surface of the water meter pit frame when the latch is moved to the locked position.

17. The water meter pit assembly according to claim 15, wherein the pivot portion is positioned on the cam at a location away from the edge having the thickest cross-section.

18. The water meter pit assembly according to claim 13, wherein the pivot portion comprises a boss of reduced size compared to the cam, the boss extending upwardly from a portion of the cam toward a bottom surface of the cover.

19. The water meter pit assembly according to claim 18, wherein the cam is comprised of an ovoid shape with the pivot portion being positioned offset from a center of the cam.

20. The water meter pit assembly according to claim 18, wherein the pivot opening is eccentrically positioned near an outer edge of the cam.

21. The water meter pit assembly according to claim 13, wherein the pivot actuator comprises a fastener having an enlarged head portion that is accessible from a top surface of the cover and a body portion that is received within the pivot opening.

22. The water meter pit assembly according to claim 21, wherein the body portion has a first portion of a first cross-section and a second portion of a second cross-section that is smaller than the first cross-section to form an abutment surface that cooperates with the pivot portion to position the fastener at a desired location within the pivot opening.

23. The water meter pit assembly according to claim 22, wherein the first and second cross-sections comprise D-shapes and wherein the pivot opening comprises a corresponding D-shaped opening.

24. The water meter pit assembly according to claim 21, wherein a distal end of the body portion includes a groove, and including a retaining ring received within the groove to secure the fastener to the latch body.

25. A water meter pit assembly comprising:

a water meter pit frame including a base portion to be supported by a water pit column and a top portion that defines an opening, and including a frame wall extending between the base portion and top portion, the frame wall including an inner peripheral wall surface and an outer peripheral wall surface;

a cover supported within the opening;

a latch moveable between a locked position where the cover is held fixed relative to the water meter pit frame to close the opening and an unlocked position where the cover is moveable relative to the water meter pit frame to allow access to the opening, and wherein the latch comprises one common latch that can be used with a cast iron, aluminum, or plastic material cover and can be used with either a cap-style or flush-style cover, and wherein the latch comprises a latch body including a pivot actuator configured to rotate the latch body and a rotatable cam portion that engages the inner peripheral wall surface of the water meter pit frame when in the locked position;

wherein the pivot actuator is received within a pivot portion of the latch body that is positioned offset from a center of the cam;

wherein the cam portion includes an outer peripheral surface that is in direct abutting engagement with the inner peripheral wall surface of the water meter pit frame when in the locked position;

wherein the outer peripheral surface of the cam portion is spaced downwardly from the top portion of the water meter pit frame to directly engage the inner peripheral wall surface of the water meter pit frame at a location spaced apart from the top portion of the water meter pit frame; and wherein the pivot actuator includes an enlarged head portion and a body portion that extends downwardly from the head portion, and wherein the body portion has a first portion of a larger cross-section and a second portion with a smaller cross-section to define an abutment surface that provides a stop for the pivot actuator when inserted into the pivot portion.

26. The water meter pit assembly according to claim 25, wherein the pivot actuator is received within a pivot portion of the latch body that includes a pivot opening eccentrically positioned near an outer edge of the cam portion, and wherein the pivot actuator selectively rotates the cam into engagement with the inner peripheral wall surface of the water meter pit frame to achieve the locked position.

27. The water meter pit assembly according to claim 26, wherein the cam portion includes a sloped surface that slopes from one edge of the latch body having a thickest cross-section to an opposite edge of the latch body that has a thinnest cross-section, and wherein the pivot portion is positioned on the cam portion at a location away from the edge having the thickest cross-section, and wherein a peripheral side surface of the cam portion at the thickest cross-section is rotated by the pivot actuator into engagement with the inner peripheral wall surface of the water meter pit frame when the latch is moved to the locked position.

28. The water meter pit assembly according to claim 27, wherein the pivot actuator comprises a fastener having an enlarged head portion that is accessible from a top surface of the cover and a body portion that is received within the pivot opening, and wherein the body portion has a first portion of a first cross-section and a second portion of a second cross-section that is smaller than the first cross-section to form an abutment surface that cooperates with the pivot portion to position the fastener at a desired location within the pivot opening.

* * * * *